US006645322B2

(12) United States Patent
Wang

(10) Patent No.: US 6,645,322 B2
(45) Date of Patent: Nov. 11, 2003

(54) METHOD FOR MAKING CARBON-STEEL BLIND SLATS AND PRODUCTS THEREOF

(76) Inventor: Chin-Han Wang, 3F-4, No. 688, Hsing-Fu Road, Hsin-Chuang City, Taipei Hsien (TW)

( * ) Notice: Subject to any disclaimer, the term of this patent is extended or adjusted under 35 U.S.C. 154(b) by 224 days.

(21) Appl. No.: 09/866,263

(22) Filed: May 25, 2001

(65) Prior Publication Data

US 2002/0176999 A1 Nov. 28, 2002

(51) Int. Cl.[7] ..... C21D 1/00

(52) U.S. Cl. ..... 148/537; 148/603; 148/604; 160/130; 160/132

(58) Field of Search ..... 148/537, 603, 148/604; 160/130, 132

(56) References Cited

U.S. PATENT DOCUMENTS 3,842,991 A * 10/1974 Koebel ..... 214/10.5 R
4,553,713 A * 11/1985 Hecht et al. ..... 242/78.1
5,846,646 A * 12/1998 Meppelink et al. ..... 428/328

* cited by examiner

*Primary Examiner*—Sikyin Ip
(74) *Attorney, Agent, or Firm*—Ostrolenk, Faber, Gerb & Soffen, LLP

(57) ABSTRACT

A method is provided for making carbon-steel blind slats and products thereof by slitting the carbon-steel sheet into pieces of desired width, trimming the edges, quenching, speedy cooling, tempering, and painting and baking. The blind product made by this method is merited in resilience, lifetime, easy maintenance, heat-resistance, fad-resistance, and is retrievable and reusable to conform to the environment protection conditions.

4 Claims, 3 Drawing Sheets

METHOD FOR MAKING CARBON-STEEL BLIND SLATS AND PRODUCTS THEREOF

FIELD OF THE INVENTION

This invention relates generally to blinds, particularly to a method for making carbon-steel blind slats and products thereof.

BACKGROUND OF THE INVENTION

The blind and drapery is widely used in today's living for shading the sunshine and for keeping the personal privacy, wherein the venetian blind is the most popular one.

Most of the conventional blind slats are made of plastics or aluminum. in which the plastic blind slats are formed by adding some dyestuff to a plastic material which is then heated and injected. Hence, the plastic slat is particularly advantageous in formation and in cost while it is defective in:

(1) Poor elasticity, which usually results in easy deformation and difficult rinsing;

(2) Color fad of the dye additive under the sunshine that usually causes unsightliness;

(3) Being crisped with a shorter lifetime because of sunshine, and (4) Recovery and decomposition of damaged blinds that would pollute the environment.

As shown in FIG. 1, the method for making the aluminum blind slats comprises the following steps:

(a) Slitting aluminum sheet into pieces of desired width and deburring the edge by trimming process;

(b) Paint coating, baking, and cooling the pieces down to room temperature; and (c) Rolling to default radian to complete the process.

However, the aluminum blind is defective in some other respects:

(1) Low elasticity, such that it can be bent or deformed easily to create creases that impedes cleaning of the window curtain;

(2) Unsightly folded creases; and (3) Frequent replacement of the deformed blind slats.

In view of abovesaid imperfection, after years of constant efforts in research, the inventor of this invention has consequently developed a method pertaining to the subject matter to be described below.

SUMMARY OF THE INVENTION

The primary object of this invention is to provide a method for making carbon-steel blind slats and products thereof by slitting the carbon-steel sheet into pieces of desired width, trimming the edges, quenching, speedy cooling, tempering, and paint coating and baking.

Another object of this invention is to provide a method for making carbon-steel blind slats and products thereof, whereby the blind slats made are enriched with resilience, lengthened in lifetime, persisted against deformation, and easy for maintenance. Compared with the conventional plastic or aluminum blind slats, the product of this invention will not fade away in color, get crisped, or pollute environment with chemical additives, and on the contrary, it is heat-resistant and retrievable for reuse.

For more detailed information regarding advantages or features of this invention, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE INVENTION

Figure 1:
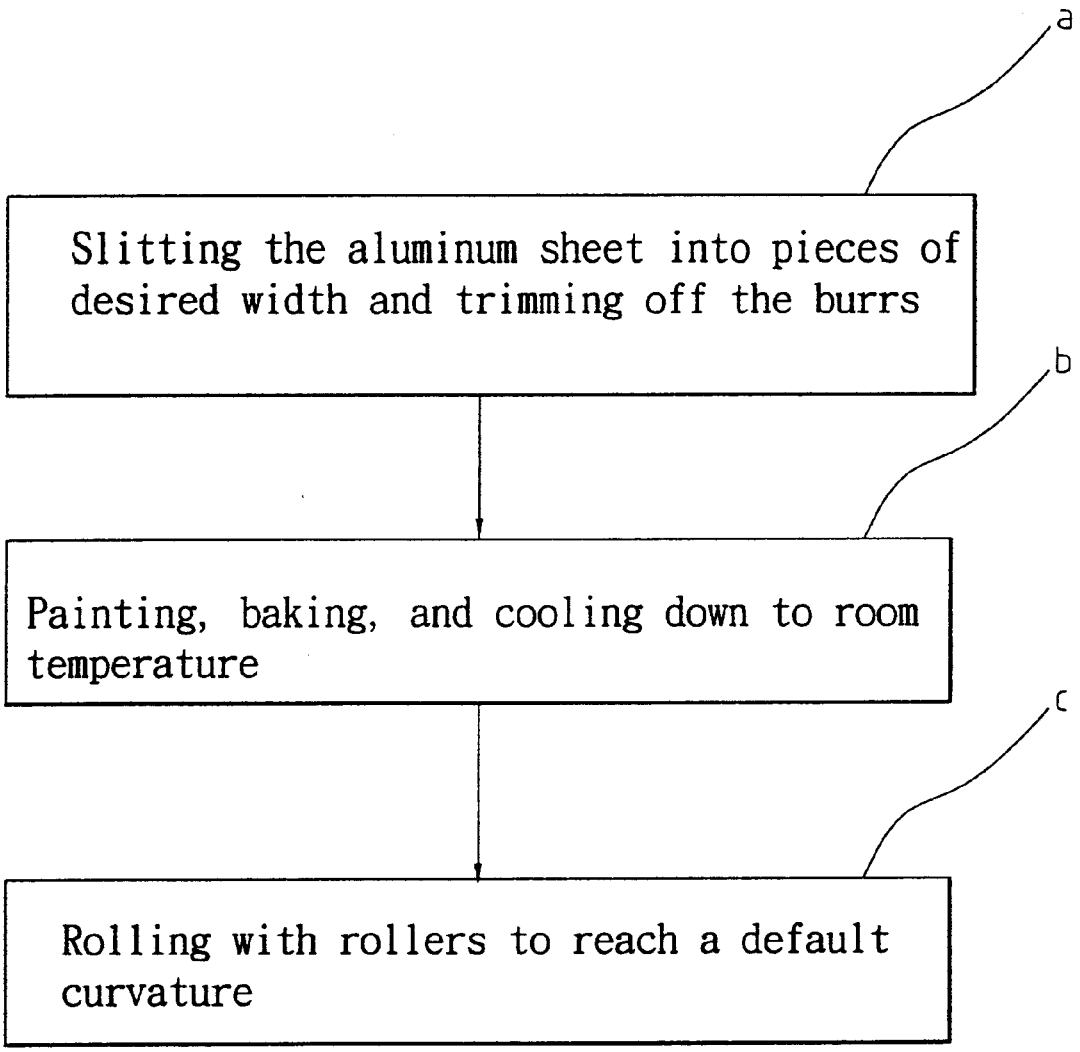
FIG. 1 is a known flowchart for making aluminum blind slats.
Figure 2:
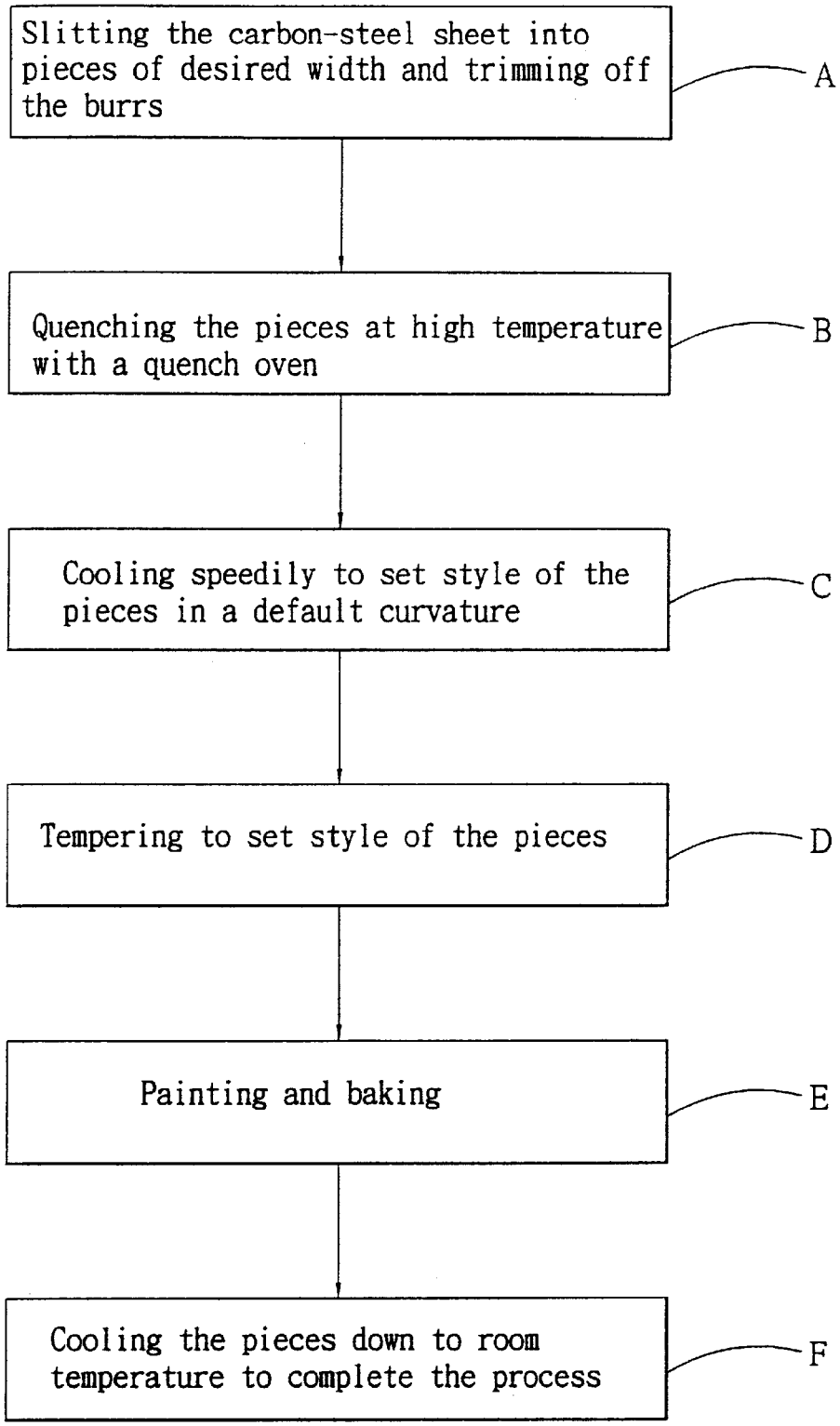
FIG. 2 is a flowchart for making carbon-steel blind slats of this invention.

As shown in FIG. 2, a flowchart for making carbon-steel blind slats of this invention mainly comprises the following steps:

(A) Slitting the carbon-steel sheet into pieces of desired width;

(B) Quenching the pieces in a quench oven;

(C) Cooling speedily to set style of the pieces in a default curvature;

(D) Tempering to set style of the pieces;

(E) Painting and baking the pieces; and (F) Cooling the pieces down to room temperature to complete the process; wherein the optimum temperature range for quenching in step (B) is 850~950° C; the optimum temperature range for cooling in step (C) is 5~20° C.; and the optimum temperature range for tempering in step (D) is 30~50° C.

Figure 3:
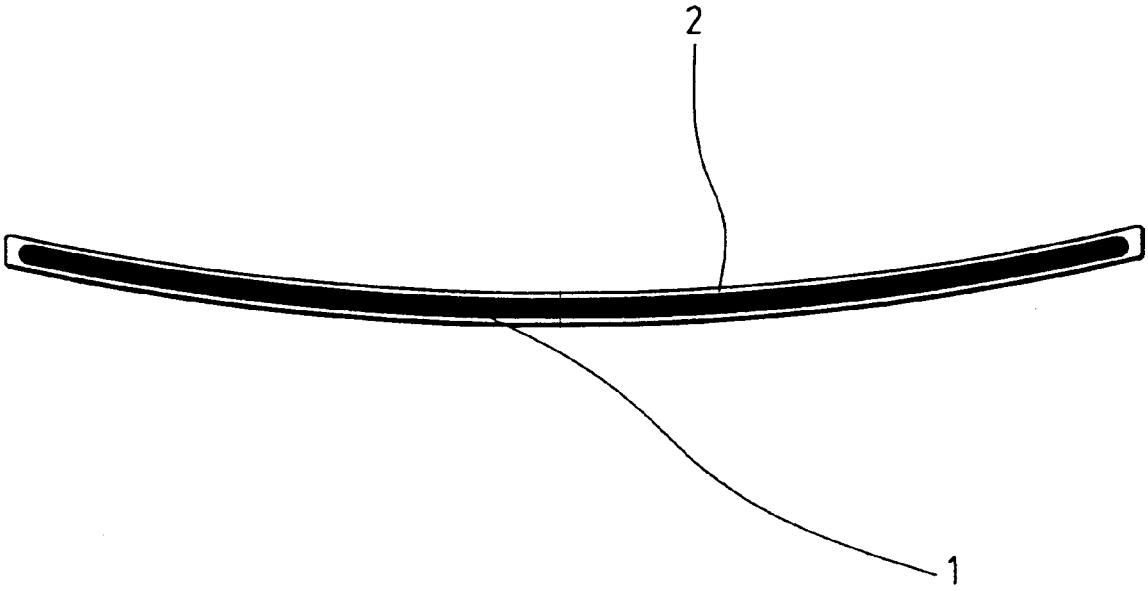
FIG. 3 is a sectional view of the carbon-steel blind slat of this invention.

The carbon-steel blind slat of this invention shown in FIG. 3 basically comprises a carbon-steel slat 1 coated with baking paint 2, wherein the slat 1 contains the constituent of carbon at 35~105° C. or in the range of 1030~1095 according to the American Iron and Steel Institute (AISI).

In summarizing the abovesaid, the carbon-steel blind slat made by the method of this invention is highly resilient, usable in a long lifetime, persisted against deformation, and easy for cleaning and maintenance that has eliminated the defects of a plastic or aluminum blind slat.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A method for making carbon-steel blind slats, comprising the following steps:

(A) Slitting the carbon-steel sheet into pieces of desired width and trimming off the burrs attached thereon;

(B) Quenching the pieces in a quench oven;

(C) Cooling speedily to set style of the pieces in a default curvature;

(D) Tempering to set style of the pieces;

(E) Painting and baking the pieces; and (F) Cooling the pieces down to room temperature to complete the process.

2. The method according to claim 1, wherein the optimum temperature range for quenching the pieces in the step (B) is 850~950° C.

3. The method according to claim 1, wherein the optimum temperature range for cooling the pieces in the step (C) is 5~20° C.

4. The method according to claim 1, wherein the optimum temperature range for tempering the pieces in step (D) is 30~50° C.

* * * * *